US006739235B2

(12) United States Patent
Mentink

(10) Patent No.: US 6,739,235 B2
(45) Date of Patent: May 25, 2004

(54) HYDRAULIC CONTROL DEVICE

(75) Inventor: Laurentius Andreas Gerardus Mentink, Haaksbergen (NL)

(73) Assignee: Actuant Corporation, Glendale, WI (US)

( * ) Notice: Subject to any disclaimer, the term of this patent is extended or adjusted under 35 U.S.C. 154(b) by 0 days.

(21) Appl. No.: 10/191,627

(22) Filed: Jul. 8, 2002

(65) Prior Publication Data

US 2003/0056507 A1 Mar. 27, 2003

(30) Foreign Application Priority Data

Jul. 9, 2001 (NL) ..... 1018501

(51) Int. Cl.[7] ..... F15B 15/22
(52) U.S. Cl. ..... 91/395; 91/408; 91/405
(58) Field of Search ..... 91/395, 396, 405, 91/407, 408, 409

(56) References Cited

U.S. PATENT DOCUMENTS 3,559,535 A * 2/1971 Conolly ..... 91/396
3,691,902 A * 9/1972 Lebzelter ..... 91/396
3,805,672 A * 4/1974 Pekrul ..... 91/396
4,138,928 A * 2/1979 Pilch ..... 91/395
4,344,733 A * 8/1982 Hirsch ..... 91/395
5,193,433 A * 3/1993 Reimer ..... 91/409

FOREIGN PATENT DOCUMENTS

| | | |
|---|---|---|
| EP | 1 031 697 A1 | 8/2000 |
| FR | 1436475 A | 7/1966 |
| GB | 2 010 399 A | 6/1979 |
| GB | 2 054 734 A | 2/1981 |

* cited by examiner

*Primary Examiner*—Thomas E. Lazo
(74) *Attorney, Agent, or Firm*—Quarles & Brady LLP

(57) ABSTRACT

A hydraulic control device having a hydraulic actuator with a cylinder space, in which a piston is accommodated. In the cylinder space the piston bounds a first chamber and second chamber. The housing is provided with a first and a second connection for the supply and discharge of hydraulic fluid, in communication with the first and the second chamber by way of a first and a second opening. The damping means are achieved by the fact that the piston is provided with shut-off means, which are designed to shut off the second opening of the cylinder space before the piston/piston rod assembly reaches an end position. The hydraulic actuator is further provided with a third connection, which by way of a third opening is in communication with the second chamber in any position of the piston. The hydraulic control device further comprises a throttling facility.

4 Claims, 1 Drawing Sheet

HYDRAULIC CONTROL DEVICE

FIELD OF THE INVENTION

The present invention relates to a hydraulic control device with a first hydraulic actuator, which actuator has a housing containing a cylinder space in which a piston/piston rod assembly is accommodated in such a way that it can move axially to and fro between corresponding first and second end positions, which piston/piston rod assembly projects out of the housing.

In the cylinder space the piston/piston rod assembly bounds a first chamber and second chamber, which chambers have a volume that depends on the position of the piston/piston rod assembly, the volume of the first chamber being at its smallest if the piston/piston rod assembly is situated in the first end position, and the volume of the second chamber being at its smallest if the piston/piston rod assembly is situated in the second end position.

The housing is provided with a first and a second connection for the supply and discharge of hydraulic fluid, which connections are in communication with the first and the second chamber respectively by way of a first and a second opening respectively in the cylinder space.

The control device is provided with damping means for the purpose of producing a damping of the movement of the piston/piston rod assembly near the second end position.

PRIOR ART

A hydraulic control device is known, for example from the applicant's EP 1 031 697.

In the case of this known control device the first hydraulic actuator is provided with a bypass channel, along which fluid supplied to a chamber of the hydraulic actuator can flow fully or partially away if the piston has cleared the inflow opening of the bypass channel. The bypass channel produces the effect that the speed of movement of the piston/piston rod assembly is damped before the end position is reached. The power that can be delivered by the hydraulic actuator also decreases as soon as fluid supplied under pressure to a chamber of the actuator can flow away by way of the bypass channel.

In practice, it happens that damping of the speed of movement of the piston/piston rod assembly is desirable, but that it is a problem that the power that can be delivered by the actuator decreases already before the end position has been reached.

OBJECT OF THE INVENTION

The object of the present invention is to provide an improved hydraulic control device, by means of which, on the one hand, a good damping action can be obtained and, on the other hand, the actuator can continue to deliver power effectively until it reaches its end position.

SUMMARY OF THE INVENTION

The present invention achieves the abovementioned object by providing a hydraulic control device which is characterized in that the damping means are achieved by the fact that the piston/piston rod assembly is provided with shut-off means, which are designed in such a way that during movement of the piston/piston rod assembly from the first to the second end position they shut off the second opening of the cylinder space before the piston/piston rod assembly reaches the second end position, and by the fact that the first hydraulic actuator is further provided with a third connection, which by way of a third opening is in communication with the second chamber in any position of the piston/piston rod assembly, and by the fact that the hydraulic control device further comprises a throttling facility, which is connected to the third opening, for the purpose of controlling the volume flow of hydraulic fluid out of the second chamber if the second opening has been shut off by the shut-off means.

By means of the invention it is ensured that, during movement of the piston/piston rod assembly to the second end position, at a particular moment before said end position is reached the shut-off means shut off the second opening. As a result of this, the fluid from the second working chamber can now flow out only by way of the third opening and the throttling facility connected to it.

Said throttling facility limits the outflow velocity, so that the movement of the piston/piston rod assembly near the second end position is a damped movement.

The throttling facility is preferably a flow-regulating valve.

The solution according to the invention is particularly advantageous in the case of a hydraulic actuator of small diameter, in the case of which during the damping action of the actuator very small fluid volumes flow out of the second chamber. A flow-regulating valve produces a stable outflow in the case of small volumes.

In practice, it often happens that a movable part, for example a movable part of a vehicle, such as, for example, a vehicle hood assembly for covering a passenger space of the vehicle, or a vehicle boot cover, is driven by two hydraulic actuators, disposed on opposite sides of the part in question.

In that situation provision is preferably made for the hydraulic control device further to comprise a second hydraulic actuator, which is of an entirely conventional design. The damping action is therefore present in the case of the second hydraulic actuator, without any separate facility being necessary for that actuator. This is very advantageous technically and from the point of view of cost.

The throttling facility is preferably a pressure-compensated flow-regulating valve, so that the damping action obtained is substantially independent of the temperature, viscosity and pressure of the outflowing fluid. The flow-regulating valve is preferably of an adjustable design.

The invention will be explained in greater detail below with reference to the drawing.

DETAILED DESCRIPTION OF THE DRAWING

Figure 1:
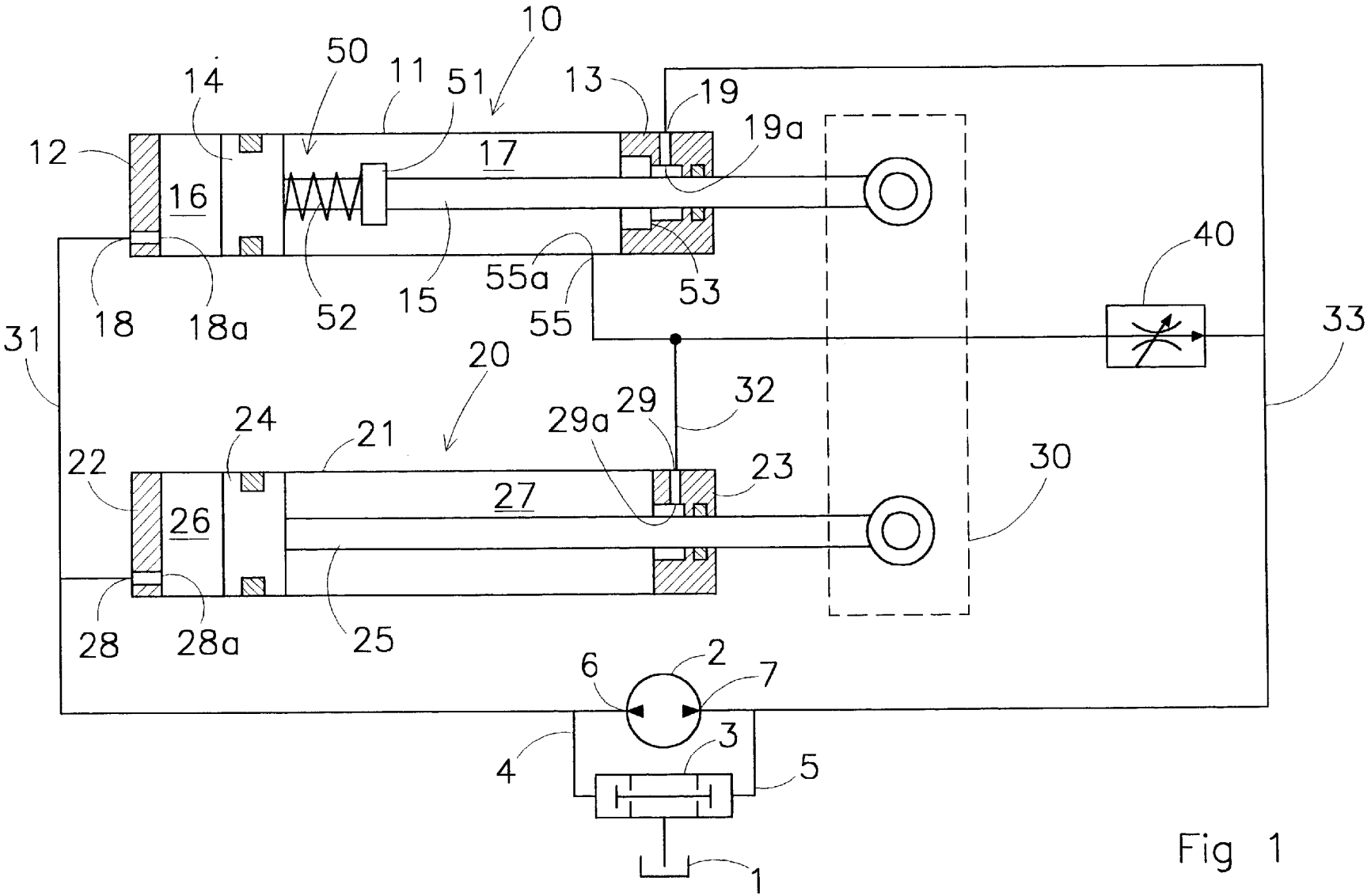
FIG. 1 shows, partly in cross section and partly diagrammatically, an exemplary embodiment of the hydraulic control device according to the invention.

FIG. 1 shows a hydraulic control device with a reservoir 1 for hydraulic fluid and a reversible pump 2, for example an electrically drivable pump.

A suction shuttle valve 3 is provided, which suction shuttle valve connects by way of pipes 4, 5 to the ports 6, 7 of the pump 2.

The control device further comprises a first hydraulic actuator 10 and a second hydraulic actuator 20. The actuators 10, 20 jointly drive an object 30, which is shown by dashed lines in the figure. For example, the object is the hood of a convertible, a vehicle boot cover, a tonneau cover or another movable part of a motor vehicle. Of course, totally different applications are also conceivable.

The first hydraulic actuator 10 is in the form of a linear cylinder and has a substantially tubular housing 11, which is closed at the axial ends by end pieces 12, 13.

A cylinder space is formed in the housing 11, in which cylinder space a piston/piston rod assembly, with piston 14 and piston rod 15, is accommodated in such a way that it can move axially to and fro between corresponding first and second end positions. The piston 14 rests against end piece 12 in the first end position and against end piece 13 in the second end position.

The piston rod 15 of the piston/piston rod assembly projects out of the housing 11 through the end piece 13.

In the cylinder space the piston/piston rod assembly bounds a first chamber 16 and a second chamber 17 with a volume that is dependent upon the position of the piston/piston rod assembly, the volume of the first chamber 16 being at its smallest if the piston/piston rod assembly is situated in the first end position, and the volume of the second chamber 17 being at its smallest if the piston/piston rod assembly is situated in the second end position.

The housing 11 is further provided with a first and a second connection 18, 19 for the supply and discharge of hydraulic fluid, which connections are in communication with the first and the second chamber 16, 17 by way of a first and a second opening 18*a*, 19*a* respectively in the cylinder space.

The first hydraulic actuator 10 is further provided with damping means for providing a damping of the movement of the piston/piston rod assembly near the second end position.

Said damping means are achieved by the fact that the piston/piston rod assembly 14, 15 is provided with shut-off means 50, which are designed to shut off the second opening 19*a* of the cylinder space during movement of the piston/piston rod assembly 14, 15 from the first to the second end position before the piston/piston rod assembly reaches the second end position.

In the example shown, the shut-off means 50 comprise an annular shut-off element 51, which is fitted in an axially slidable manner on the piston rod 15 of the first actuator 10 and sealingly engages said piston rod 15.

The shut-off element 51 has a smaller diameter than the piston 14.

The shut-off means further comprise a spring means 52, which is disposed between the piston 14 and the shut-off element 51 and presses the shut-off element 51 away from the piston 14.

The end piece 13 of the housing 11 on its side facing the piston 14 forms a seat 53 for the shut-off element 51, against which the shut-off element 51 ultimately rests during the piston/piston rod assembly movement from the first to the second end position, before the second end position has been reached.

The first hydraulic actuator 10 is further provided with a third connection 55, which in each position of the piston/piston rod assembly 14, 15 is in communication with the second chamber 17 by way of a third opening 55*a*.

The second hydraulic actuator 20 is of a commonly used design and has a housing 21 with end pieces 22, 23, which bound a cylinder space in the housing 21.

A piston/piston rod assembly with piston 24 and piston rod 25 is accommodated in the cylinder space in such a way that it can move axially to and fro between corresponding first and second end positions. The piston 24 rests against the end piece 22 in the first end position and against the end piece 23 in the second end position.

The piston rod 25 projects out of the housing 21 through the end piece 23.

In the cylinder space the piston/piston rod assembly 24, 25 bounds a first chamber 26 and second chamber 27, which chambers have a volume that depends on the position of the piston/piston rod assembly 24, 25, the volume of the first chamber being at its smallest if the piston/piston rod assembly is situated in the first end position, and the volume of the second chamber being at its smallest if the piston/piston rod assembly is situated in the second end position.

The housing 21 is provided with a first and a second connection 28, 29 for the supply and discharge of hydraulic fluid, which connections are in communication with the first and the second chamber 26, 27 respectively by way of a first and a second opening 28*a*, 29*a* respectively in the cylinder space.

The first opening 18*a* of the first hydraulic actuator is in open communication with the first opening 28*a* of the second hydraulic actuator 20 by way of a line 31, which connects to the port 6 of the pump 2.

The second opening 29*a* of the second hydraulic actuator 20 is in open communication with the third opening 55*a* of the first hydraulic actuator 10 by way of a line 32.

The hydraulic control device further comprises a throttling facility, here a flow-regulating valve 40, which is connected to the third opening 55*a*—and thus to the second opening 29*a* of the second actuator—for the purpose of controlling the outflow of hydraulic fluid from the second chambers 17, 27 if the second opening 19*a* of the first hydraulic actuator has been shut off by the shut-off means 50.

The flow-regulating valve 40 connects to line 33, which connects the second connection 19 of the first actuator 10 to the port 7 of the pump.

The flow-regulating valve 40 is preferably a pressure-compensated flow-regulating valve, so that the outflow is not sensitive to variations of the pressure, temperature and viscosity of the fluid.

The throttling facility 40 is preferably such that only a flow from the line 32 to the line 33 is throttled, and no throttling effect occurs when hydraulic fluid is being supplied to the line 32 by means of the pump 2. For example, a non-return valve is connected in parallel to the throttling port, or the flow-regulating valve is designed as such.

In the case of the control device described, the following effect is obtained. When hydraulic fluid is supplied under pressure by way of the port 6 of the pump 2 to the first connections 18, 28 of both the first and the second hydraulic actuator 10, 20, the result is that the piston/piston rod assemblies 14, 15 and 24, 25 of said actuators move from the first end position to the second end position.

So long as the shut-off means 50 are not yet in operation, fluid flows out of the second chambers 27 and 17 by way of the lines 32 and 33 to the port 7 of the pump.

At a certain point, still before the second end position is reached, the shut-off means 50 go into operation by the fact that the shut-off element 51 comes to rest against the seat 53, thereby forming a hermetic seal. From that point onwards, the second opening 19*a* is shut off from the cylinder space, and no further fluid can flow away by way of the second connection 19.

Fluid can in fact flow out of the second chamber 17 of the first actuator by way of the third opening 55*a*, and out of the second chamber of the second actuator 20 by way of the second connection 29. These fluid flows merge in the line 32 and then pass through the flow-regulating valve 40, by way of which the fluid reaches the port 7 of the pump 2.

In this way, with a single flow-regulating valve 40 an identical damping action is obtained in the case of the actuators 10, 20, in which case only the actuator 10 is then provided with the shut-off means 50 described earlier.

It will be clear that the damping action can be achieved in a similar manner near the other end position or in the case of both end positions. Furthermore, several additional actuators 20 can be damped with a single specially adapted actuator 10.

By means of the solution described, the maximum power that can be delivered is fully retained during the extension of the piston/piston rod assemblies 14, 15 and 24, 25, since the first chambers 16, 26 remain separated from the second chambers 17, 27 and no connection is made with the third opening 55*a*. The maximum power that can be delivered by the actuators 10, 20 is also fully available during the retraction of the piston/piston rod assemblies.

The third connection 55 with opening 55*a* can be covered by the piston 14 in the second end position.

What is claimed is:

1. Hydraulic control device comprising:

a first hydraulic actuator, which actuator has a housing containing a cylinder space in which a piston/piston rod assembly is accommodated in such a way that it can move axially to and from between corresponding first and second end positions, which piston/piston rod assembly projects out of the housing, in which in the cylinder space the piston/piston rod assembly bounds a first chamber and second chamber, which chambers have a volume that depends on the position of the piston/piston rod assembly, the volume of the first chamber being at its smallest if the piston/piston rod assembly is situated in the first end position, and the volume of the second chamber being at its smallest if the piston/piston rod assembly is situated in the second end position, in which the housing is provided with a first and a second connection for the supply and discharge of hydraulic fluid, which connections are in communication with the first and the second chamber respectively by way of a first and a second opening respectively in the cylinder space, and in which damping means are provided for the purpose of producing a damping of the movement of the piston/piston rod assembly near the second end position, characterized in that the damping means are achieved by the fact that the piston/piston rod assembly is provided with shut-off means, which, during movement of the piston/piston road assembly from the first to the second end position, are designed to shut off the second opening of the cylinder space before the piston/piston rod assembly reaches the second end position, and by the fact that the first hydraulic actuator is further provided with a third connection, which by way of a third opening is in communication with the second chamber in any position of the piston/piston rod, and by the fact that the hydraulic control device further comprises a throttling facility, which is connected to the third opening, for the purpose of controlling the volume flow of hydraulic fluid out of the second chamber if the second opening has been shut off by the shut-off means, and further comprising a second hydraulic actuator, which second hydraulic actuator has a housing containing a cylinder space in which a piston/piston rod assembly is accommodated in such a way that it can move axially to and fro between corresponding first and second end positions, which piston/piston rod assembly projects out of the housing, in which in the cylinder space the piston/piston rod assembly bounds a first chamber and second chamber, which chambers have a volume that depends on the position of the piston/piston rod assembly, the volume of the first chamber being at its smallest if the piston/piston rod assembly is situated in the first end position, and the volume of the second chamber being at its smallest if the piston/piston rod assembly is situated in the second end position, in which the housing is provided with a first and a second connection from the supply and discharge of hydraulic fluid, which connections are in communication with the first and second chamber respectively by way of a first and a second opening respectively in the cylinder space, in which the first opening of the first hydraulic actuator is in communication with the first opening of the second hydraulic actuator, and in which the second opening of the second hydraulic actuator is in communication with the third opening of the first hydraulic actuator.

2. Hydraulic control device according to claim 1, in which the throttling facility is a pressure-compensated flow-regulating actuator.

3. Hydraulic control device according to claim 1, in which the shut-off means comprise an annular shut-off element, which is fitted in an axially slidable manner on the piston rod of the first actuator, and which sealingly engages the piston rod of the first hydraulic actuator, which shut-off element has a smaller diameter than the piston, and in which the housing of the first hydraulic actuator forms a seat for the shut-off element, against which the shut-off element ultimately rests during the movement of the piston/piston rod assembly of the first hydraulic actuator from the first to the second end position, before the second end position has been reached.

4. Hydraulic control device according to claim 1, in which the shut-off means comprise an annular shut-off element, which is fitted in an axially slidable manner on the piston rod of the first hydraulic actuator and rests upon the piston rod of the first hydraulic actuator in such a way that it forms a seal, which shut-off element has a smaller diameter than the piston of the first hydraulic actuator, and in which the housing of the first actuator forms a seat for the shut-off element, against which the shut-off element ultimately rests during the movement of the piston/piston rod assembly of the first hydraulic actuator from the first to the second end position, before the second end position has been reached, and in which a spring means, which presses the shut-off element away from the piston of the first hydraulic actuator, is provided.

* * * * *

UNITED STATES PATENT AND TRADEMARK OFFICE

CERTIFICATE OF CORRECTION

PATENT NO. : 6,739,235 B2 
DATED : May 25, 2004
INVENTOR(S) : Laurentius Andreas Gerardus Mentink It is certified that error appears in the above-identified patent and that said Letters Patent is hereby corrected as shown below:

Column 5,
Line 56, “road” should be -- rod --.

Signed and Sealed this

Twenty-eighth Day of September, 2004

JON W. DUDAS
*Director of the United States Patent and Trademark Office*